US005915686A

United States Patent [19]

Neifert et al.

[11] Patent Number: 5,915,686

[45] Date of Patent: Jun. 29, 1999

[54] DOCUMENT ACCUMULATOR HAVING ROTATING ASSEMBLIES FOR RAMP ADJUSTMENT

[75] Inventors: Leonard Neifert, Apex, N.C.; Mark Ricker, Tatamy, Pa.

[73] Assignee: Bell & Howell Phillipsburg Company, Allentown, Pa.

[21] Appl. No.: 08/935,339

[22] Filed: Oct. 2, 1997

Related U.S. Application Data

[62] Division of application No. 08/544,807, Oct. 18, 1995, Pat. No. 5,692,745.

[51] Int. Cl.[6] ..... B65H 43/04

[52] U.S. Cl. ..... 271/198; 271/212; 271/213; 271/223; 414/790.7

[58] Field of Search ..... 271/198, 184, 271/212, 213, 223; 414/790.7

[56] References Cited

U.S. PATENT DOCUMENTS

| | | | |
|---|---|---|---|
| 2,938,723 | 5/1960 | Paulson . | |
| 3,180,475 | 4/1965 | Del Rosso . | |
| 4,369,959 | 1/1983 | Hornbuckle . | |
| 4,805,891 | 2/1989 | Luperti et al. . | |
| 5,054,760 | 10/1991 | Reist . | |
| 5,094,443 | 3/1992 | Young, Jr. . | |
| 5,209,467 | 5/1993 | Schmaling . | |
| 5,244,200 | 9/1993 | Manzke | 271/212 X |
| 5,299,371 | 4/1994 | Haberstroh . | |

FOREIGN PATENT DOCUMENTS

| | | |
|---|---|---|
| 557241 | 11/1957 | Belgium . |
| 2471935 | 6/1981 | France . |

*Primary Examiner*—Boris Milef
*Attorney, Agent, or Firm*—Millen, White, Zelano & Branigan, P.C.

[57] ABSTRACT

A document accumulator comprising for high-speed document assembly includes first and second pulleys, a first outer belt extending between the first and second pulleys for contacting and transporting a document, a second outer belt extending between the first and second pulleys, and extending generally parallel to and horizontally displaced from the first outer belt, for contacting and transporting a document, and an inner belt generally parallel to and horizontally displaced from both the first and second outer belts such that it lies between the first and second outer belts. A first side guide has a first vertical surface adjacent to a horizontal reach of the first outer belt, and a second side guide has a second vertical surface adjacent to a horizontal reach of the second outer belt. A belt-dampening table having a horizontal surface adjacent to a horizontal reach of the inner belt is provided for dampening oscillations of the inner belts which occur at high speeds. At least two ramps for performing over- and under-accumulation are each mounted on a shaft connected at each end to a rotating assembly. Cam-type release levers permit the rotating assemblies, and thus the ramps, to be rotated and translated without the use of tools.

2 Claims, 3 Drawing Sheets

DOCUMENT ACCUMULATOR HAVING ROTATING ASSEMBLIES FOR RAMP ADJUSTMENT

This is a division of the application Ser. No. 08/544,807 filed Oct. 18, 1995 now U.S. Pat. No. 5,692,745.

BACKGROUND OF THE INVENTION

1. Field of the Invention

The invention relates in general to insertion machines for compiling sets of documents and inserting such sets into envelopes, and in particular to an accumulator device having a belt-dampening table and side guides for dampening the oscillating tendencies of the belts when driven at high speeds.

2. Related Art

Belt-driven accumulators are well-known for accumulating sets of documents from a stream of documents fed seriatim thereto. Such accumulators typically include at least two driven belts which engage a document at its upper and lower surface, respectively, shaft-mounted pulleys for directing and driving the belts, two side guides which engage and guide the edges of documents being transported by the belts, a ramp for directing the document upward onto the top of a stack of accumulated documents ("over-accumulation") or downward under a stack of documents ("under-accumulation"), and a sheet-restraining means for preventing the stacked documents from being fed by the belts until all sheets for a particular set have been accumulated.

However, belt-driven ramp accumulators of the prior art have typically had limitations which prevent them from being operated reliably at very high speeds. Such limitations include the inability to operate consistently at certain speeds without jamming due to, e.g., document collisions.

OBJECTS AND SUMMARY OF THE INVENTION

It is therefore an object of the invention to provide a belt-driven accumulator which can be reliably operated at high speeds without jamming.

The invention according to a preferred embodiment comprises a document accumulator having first and second pulleys, a first outer belt extending between the first and second pulleys for contacting and transporting a document, a second outer belt extending between the first and second pulleys, and extending generally parallel to and horizontally displaced from the first outer belt, for contacting and transporting a document, and an inner belt generally parallel to and horizontally displaced from both the first and second outer belts such that it lies between the first and second outer belts. A first side guide means has a first vertical surface adjacent to a horizontal reach of the first outer belt, and a second side guide means has a second vertical surface adjacent to a horizontal reach of the second outer belt means. A belt-dampening table having a horizontal surface adjacent to a horizontal reach of the inner belt means is provided for dampening oscillations of the inner belts which occur at high speeds.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION

Figure 1:
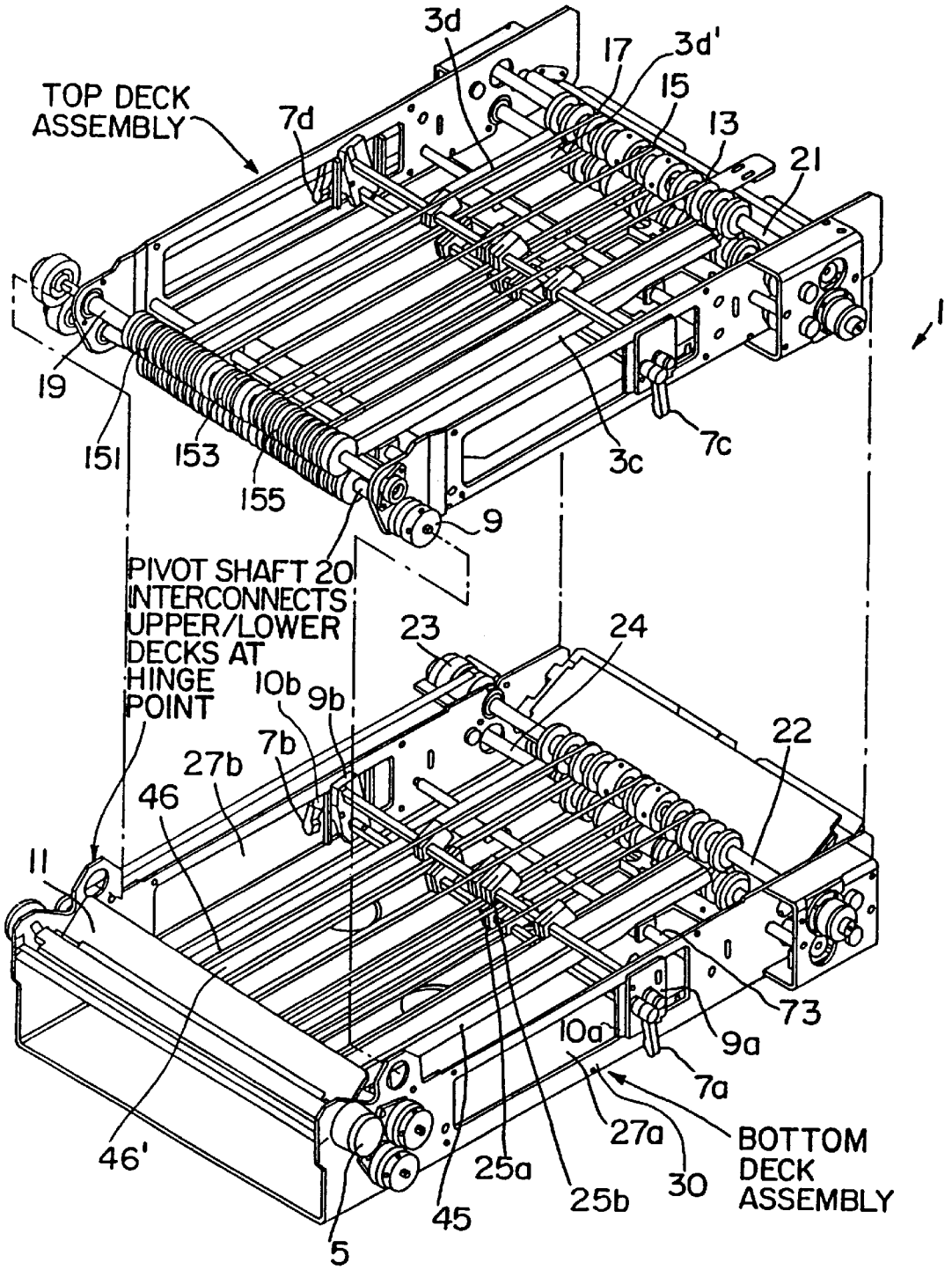
FIG. 1 is a perspective view illustrating the accumulator of the invention.

FIG. 1 illustrates a double-level accumulator 1 having top and bottom deck assemblies and a divert gate 11 for selecting whether documents fed to the accumulator will be received in the lower or upper deck. Deck selection is controlled via operation of the gate solenoid 5 to position the divert gate 11. During steady-state operation, the deck selection will normally alternate at each new set.

Each deck comprises an upper and lower belt assembly, with each assembly comprising three belts, e.g., belts 13, 15, and 17, which are retained by three pulleys mounted on each of the respective shafts, e.g., shafts 19 and 21. The belts are preferably the "round" type, also known in the art as "spaghetti belts." Motion of the belts is accomplished via a clutch 23 operably connected to a motor.

Each deck comprises at least two ramps, e.g., 25*a* and 25*b*, for performing over-accumulation and under-accumulation, respectively. Each ramp is mounted on a shaft which is in-turn connected at a first end to a rotating assembly and at a second end to a second rotating assembly. The first rotating assembly comprises an outer bracket 9*a* and an inner bracket 10*a*, and the second rotating assembly comprises an outer bracket 10*b* and an inner bracket 9*b*. Cam-type release levers 7*a*, 7*b*, 7*c*, and 7*d* can be operated without the use of tools to permit the rotating assemblies 9*a* and 9*b* to be rotated upwards for over-accumulation or downwards for under-accumulation. When the release levers are in a closed position, the inner and outer brackets are biased toward each other such that they are tightly clamped to the frame 30. In an open position, the inner and outer brackets do not clamp the frame, whereby the inner bracket is permitted to rotate and the entire rotating assembly is permitted to translate along the slots, e.g., 27*a* and 27*b*.

When the rotating assemblies are rotated in a first direction, the lower ramp 25*a* rotates upwardly, whereby it will engage an incoming sheet and direct it upwardly onto the top of a stack of accumulated documents. When the assemblies are rotated in a second direction, the upper ramp 25*b* rotates downward such that it will engage an incoming sheet and direct it downward under a stack of accumulated documents. The rotating assemblies are longitudinally translatable in slots 27*a* and 27*b* to adjust for various paper lengths.

Side guides 45, 46, 3*c*, and 3*d* are provided for guiding the outer edges of documets as they are transported through the accumulator. All of the side guides are laterally translatable to adjust for various paper widths. The side guides are moved into a lateral position which places them adjacent to the outer-most belts, which are described in more detail below. This adjacent relationship permits the side guides to act as a dampening means to dampen oscillations of the outer-most belts when the belts are moving at high speeds.

Three multi-grooved pulleys 51, 53, and 55 are mounted on the shaft 19. A similar configuration is used on the other shafts, e.g., 20, 22, 24, etc. Each of the three endless belts 13, 15, and 17 engage one groove of each of the multi-grooved pulleys 51, 53, and 55, respectively, such that each belt extends between the shafts 19 and 21. By providing multiple grooves into which a belt can be placed, the accumulator can be easily reconfigured for various paper sizes.

For example, for accumulating sheets having a relatively wide paper width, the belts 13 and 17 can by physically moved by an operator, without the use of tools, into the outer grooves of the multi-grooved pulleys 55 and 51, respectively. Likewise, for accumulating sheets having a relatively narrow paper width, the belts 13 and 17 can be physically moved into the inner grooves of the multi-grooved pulleys 55 and 51. Similar adjustments can then be made between grooves of the other pulleys in the system. In this manner, the accumulator can be quickly and easily configured for paper widths ranging from, e.g., 6 inches wide to 12 inches wide. It should be understood that a "multi-grooved pulley" within the scope of the invention could include, e.g., two or more adjacent pulleys having single grooves.

The pivot shaft shown in FIG. 1, which is a drive shaft for the upper deck, serves also to interconnect the upper and lower decks such that it becomes a hinge point around which the upper deck can be rotated. This facilitates access to the lower deck by releasing and pivoting up the upper deck without the need for a time-consuming deck-removal process.

Figure 2:
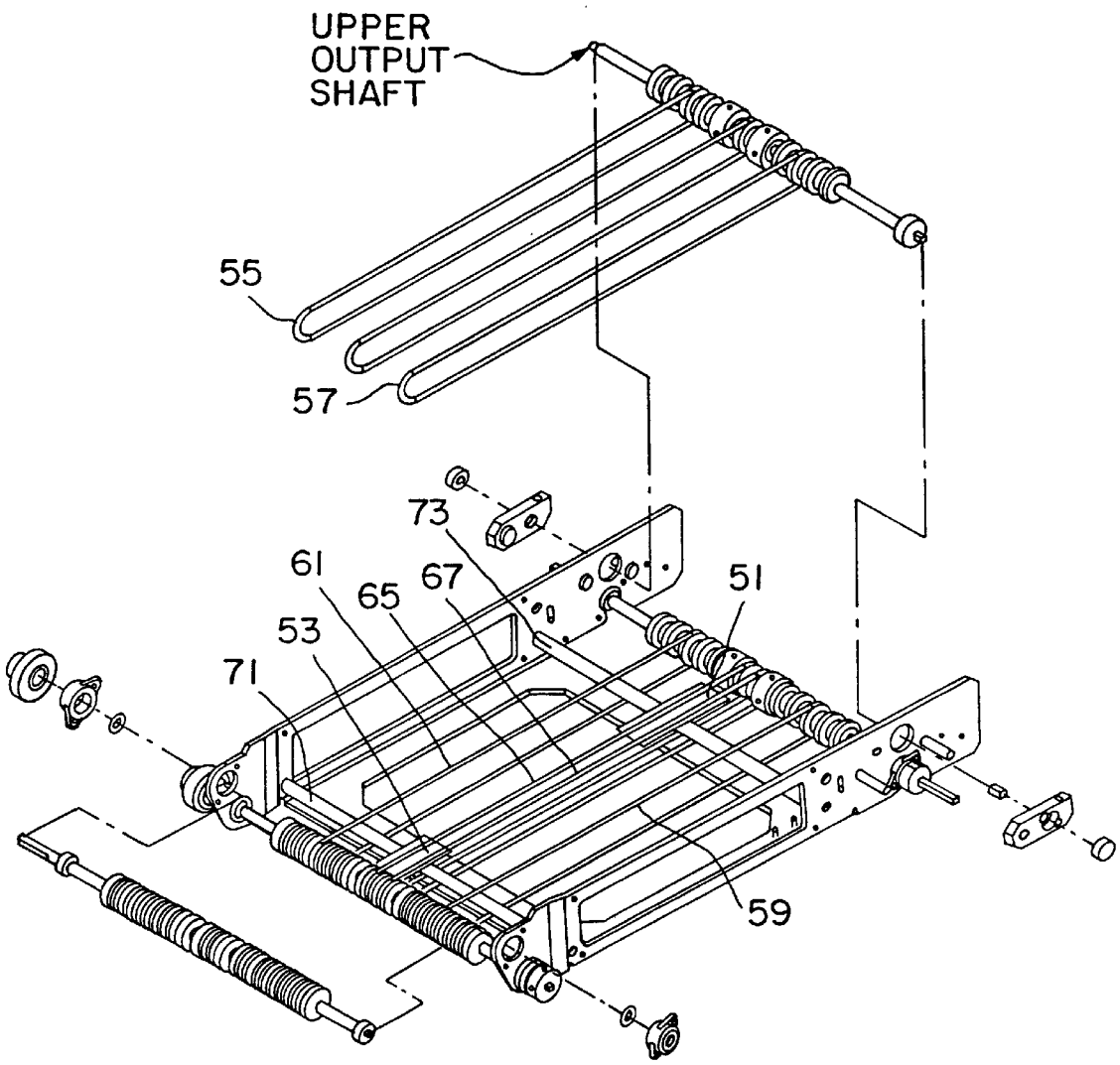
FIG. 2 is a partial perspective view of the lower deck of the accumulator of the invention.
Figure 3:
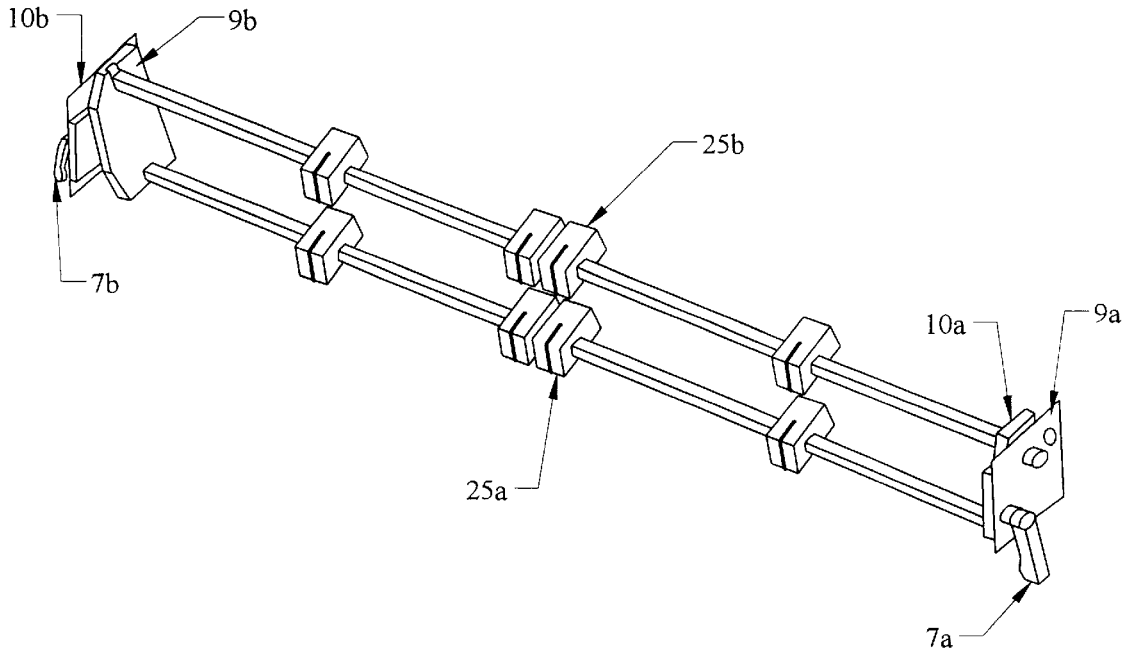
FIG. 3 is a perspective view illustrating an adjusting mechanism according to the invention.

FIG. 2 shows a partial view of the lower deck of the accumulator, with some portions removed for purposes of illustration. The two side guides discussed above with reference to FIG. 1 are positioned adjacent to the outer-most belts 55, 61 and 57, 59, respectively, to dampen oscillations. Specifically, the side guides are positioned to contact the belts 55 and 57 along their lower reaches and the belts 59 and 61 along their upper reaches. These particular reaches are dampened because they are reaches that come into contact with a document being transported through the accumulator.

However, such side guides are not used to dampen the document-contacting reaches of the inner belts in that placing side guides adjacent to such reaches would obstruct the document path through the accumulator. First and second belt-dampening tables 51 and 53 are provided to dampen oscillations of the document-contacting reaches of the inner belts 65 and 67. The first and second belt-dampening tables 51 and 53 are mounted on first and second mounting shafts 73 and 71, respectively, such that their upper horizontal surfaces lie just beneath the upper reaches of the belts 65 and 67. The mounting shafts 73 and 71, and the belt-dampening tables 51 and 53 mounted thereto, lie between upper and lower reaches of the belts 59, 61, 65, 67. The ends of the horizontal surfaces of the tables 51 and 53 may be tapered downward away from their adjacent belts so as to reduce the belt-wear caused by engagement of the belts by the tables at high speeds.

It should be noted that the lower deck is illustrated in FIG. 2 and that identical or similar belt-dampening tables may be used in the upper deck of the accumulator of the invention.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A document set accumulator for receiving and accumulating documents, comprising:

upper and lower belt assemblies for receiving documents therebetween;

upper and lower ramp means for selectively guiding said documents to either over-accumulate or under-accumulate;

shaft means extending transverse to said upper and lower belt assemblies for supporting said upper and lower ramp means mounted thereto;

first and second rotating assemblies attached to first and second ends of said shaft means, said first and second rotating assemblies comprising first and second bracket means for releasably compressing against a frame portion of the document set accumulator;

finger-operable release means for releasing said first and second bracket means, whereby said rotating assemblies are permitted to rotate between a first position, at which at least one of said ramp means guides said documents into over-accumulation, and a second position, at which at least one of said ramp means guides said documents into under-accumulation.

2. The document accumulator set forth in claim 1, wherein said fiber-operable release means comprises first and second release levers.

* * * * *